United States Patent [19]

Reijonen et al.

[11] Patent Number: 4,761,997

[45] Date of Patent: Aug. 9, 1988

[54] GROUND WATER WELL DIMENSIONING PROCEDURE

[75] Inventors: Veli E. Reijonen; Risto Reijonen, both of Helsinki, Finland

[73] Assignee: Veli Reijonen Oy, Helsinki, Finland

[21] Appl. No.: 799,746

[22] Filed: Nov. 19, 1985

[30] Foreign Application Priority Data

Nov. 20, 1984 [FI] Finland ..... 844558

[51] Int. Cl.[4] ..... E21B 49/00

[52] U.S. Cl. ..... 73/155; 73/38

[58] Field of Search ..... 73/151, 155, 38; 166/250

[56] References Cited

U.S. PATENT DOCUMENTS

| | | | |
|---|---|---|---|
| 2,605,637 | 8/1952 | Rhoades | 73/151 |
| 3,285,064 | 11/1966 | Greenkorn et al. | 73/155 |
| 3,321,965 | 5/1967 | Johnson et al. | 73/155 |
| 3,877,301 | 4/1975 | Jensen, Jr. | 73/155 |
| 4,142,411 | 3/1979 | Deal | 73/155 |
| 4,677,849 | 7/1987 | Ayoub et al. | 73/155 |

OTHER PUBLICATIONS

Brochure of the SE 200 Hydrologic Analysis System, produced by In Situ Inc., Laramie, WY.

Brochure of the Hermit Hydrologic System, produced by In Situ Inc., Laramie, WY.

Walton, W. C., Selected Analytical . . . Evaluation, 1962, State of Illinois, Bulletin No. 49, pp. i, ii, 63 and 64.

Brochure of Endress and Houser GmbH and Co., Maulburg, W. Germany.

*Primary Examiner*—Jerry W. Myracle

*Attorney, Agent, or Firm*—Murray Schaffer

[57] ABSTRACT

The dimensioning of a ground water well is obtained by investigating the yield characteristics of the ground water region by conducting a series of pumping runs using an observation tube in stepwise pumping cycles of short time intervals (15 seconds to 20 minutes), and measuring the hydrostatic height of the water of each run, finding the yields as a function of the level drop. The yield of the production well, compared with the yield of the observation tube, is found from the ratio of the strainer sections and observation tube, using a predetermined empirical factor corresponding to the different sizes of the strainer. In the case of ground water deposits at very great depth, the yield may be explored by an inverted method in that water is pumped into the ground and the hydrostatic pressure is measured with different pumping rates.

9 Claims, 2 Drawing Sheets

GROUND WATER WELL DIMENSIONING PROCEDURE

BACKGROUND OF THE INVENTION

The object of the present invention is to improve the dimensioning of a ground water well, whereby a result is achieved which is more accurate than at present.

The objective, in planning a ground water well, is to obtain the most efficient utilization of the available ground water deposit i.e. the aquifer.

In planning the installation of a ground water well, the soil and ground water conditions of the selected site are explored and investigated. Reliable basic information is significant if one desired to avoid incorrect installation.

A good investigation should result in obtaining the following information:

- the soil of the water supply area (borings, soil samples)
- the yield capacity of test pumpings (yields at different depths, observations during runs)
- of trial pumpings (yield declines in the water supply area)
- ground water quality measurements in the water supply area
- laboratory examinations of water samples
- topographical surveys (elevations of points of investigation) within the water supply area
- measurements (ground plan of the water supply area, locations of points of investigation).

Furthermore, information is needed on the planned yield of the water supply area; average yield in m$\alpha$/d and momentary maximum yield in dm$\alpha$/s.

GENERAL FUNDAMENTALS USED IN THE PRIOR ART

The results obtained from well site exploration are the starting point for the dimensioning and planning of the intended well and is directed in the first place to determining the extent and location of the well's flow area. The flow area is that part of a well through which the ground water flows into the well, i.e., the surface area of the outer circumstances of a well tube strainer section or of a well shaft bottom. Location is understood to be the localisation of the flow area in the vertical direction of the soil layer and which is equal to the height or depth.

A decisive effect is exerted on the dimensioning of the well by the water conductivity of the soil layer outside the above-mentioned flow area. It is important that the allowable flow rate is not exceeded. This is determined on the basis of the effective grain size ($d_{10}$) of the soil. Even through the procedure just outlined may often be inaccurate, it is appropriate to be used at ground water supply sites. Problems arise, in the first place, from the fact that the soil samples are not fully representative of the natural state, and therefore the effective grain size found in the laboratory may differ from the true value.

Hencetofore, the dimensioning of a well has taken place in conjunction with site exploration. The practice has then been to make borings and to take soil samples to determine the water conductivity of the soil. In addition, endeavours have been made to assure the yield capacity with the aid of pumping runs.

It is general practice to estimate on the basis of soil samples the water quantity obtainable from the well, in accordance with the so-called German standard. When using this, sieve analysis of the soil samples are made, whereby the so-called granulation samples (or the screening curve) are obtained. From the granulation sample, the so-called effective grain size $d_{10}$) is determined. Thereafter, usually the following formula (1) is applied:

$$Q = \frac{D_p \pi h \times d_{10}}{280} \quad \text{(i)}$$

where

Q=water quantity obtainable from the well
D=boring diameter
h=length of the strainer tube
d=so-called effective grain size Attempts are made to fit the strainer tube, as proper as possible, considering the granulation of the soil, the lowering of the ground water table (seasonal variations and drop due to withdrawal) and qualitative aspects.

Moreover, the level drop in a tube well is estimated by the formula (2):

$$s_{rt} = \frac{2{,}3Q}{4\pi T} \log \frac{2{,}25\ Tt}{r^2 S} \quad (2)$$

where

S=level drop in the well
Q=water quantity obtainable from the well
T=water conductivity of the ground water deposit=0.01157×d×b; b is the thickness of the water-conducting layer
t=pumping time
r=radius of the well
s=storage coefficient The water conductivity T of a ground water deposit may also be defined on the basis of pumping runs that are carried out.

DRAWBACKS OF THE PRIOR ART

When well dimensioning has been performed using the methods of the prior art, the results have been inaccurate. The inaccuracies have been due to the following causes, among others:

The test samples have not been representative, that is, there is something else underground than is indicated by the soil samples. In fact, it has occurred that on boring through rock a result has been obtained according to which there seemed to be a water-permeable soil layer instead of rock. The error is due to such boring being done with compressed air equipment, which comminutes the rock and stone into more finely divided matter.

In addition, the grain composition of the soil is not the sole factor influencing water conductivity. It is also affected by the compactness and grain shape of the soil (schist for instance does not conduct water very well). Even though the soil samples should be representative of the soil at the point of observation, the soil, 3 meters distance therefrom, may be something else, and have an influence on the exploration.

SUMMARY OF THE INVENTION

With the aid of the present invention, the drawbacks of known methods are eliminated and a ground water well dimensioning procedure is obtained in which even at the exploration phase, provides a result of higher accuracy than was achieved heretofore.

With the aid of the invention, the length and location of the ultimate well's strainer tube can be determined, in advance and with more accurately than hereto. Therefore, in most cases, a smaller quantity of strainer tubing is required, and the depth of the well can be reduced. This lowers well-construction costs.

According to the present invention, the dimensioning of a ground water well is obtained through the use of an observation tube through which a series of pumping runs are performed in stepwise fashion. Flows of different velocity are induced in the soil and the hydrostatic height, thus created is measured. The measurement is extrapolated by a predetermined correlation factor to provide an accurate single well for flow rates required.

In this way, the sizing of a ground water well, is easily calculated in the planning stage, by investigating the yield characteristics of the ground water region, obtaining correct data as possible, especially when the water supply of a habitation centre or of an industrial plant is concerned. According to the present invention, the initial exploration consists of a plurality of pumping runs using an observation tube rather than a final well shaft. The pumping is conducted stepwise using short time intervals (15 seconds to 20 minutes), and the hydrostatic height of the water in each run is measured. In this way, one finds the yield of the observation tube as a function of the level drop. The yield of a well, compared with the yield of the observation tube, is then determined from the ratio of the strainer sections of well and observation tube, using an empirical predetermined factor corresponding to the different sizes of the strainers. In the case of ground water deposits at very gret depth, the yield of the observation tube may be explored by an inverted method in that water is pumped into the ground and the hydrostatic pressure is measured with different pumping rates.

BRIEF DESCRIPTION OF THE DRAWINGS

In the following, the invention and the advantages gained thereby are described in more detail with reference to the attached drawings, of which.

DESCRIPTION OF THE INVENTION

The preliminary water supply area is determined in connection with normal ground water investigations. Next, well site explorations are carried out, involving the placing in the earth of an observation tube of diameter about 20 to 100 mm, most often 32–50 mm. Depending on the site, the length of the observation tube is between 2 and 60 m.

Figure 1:
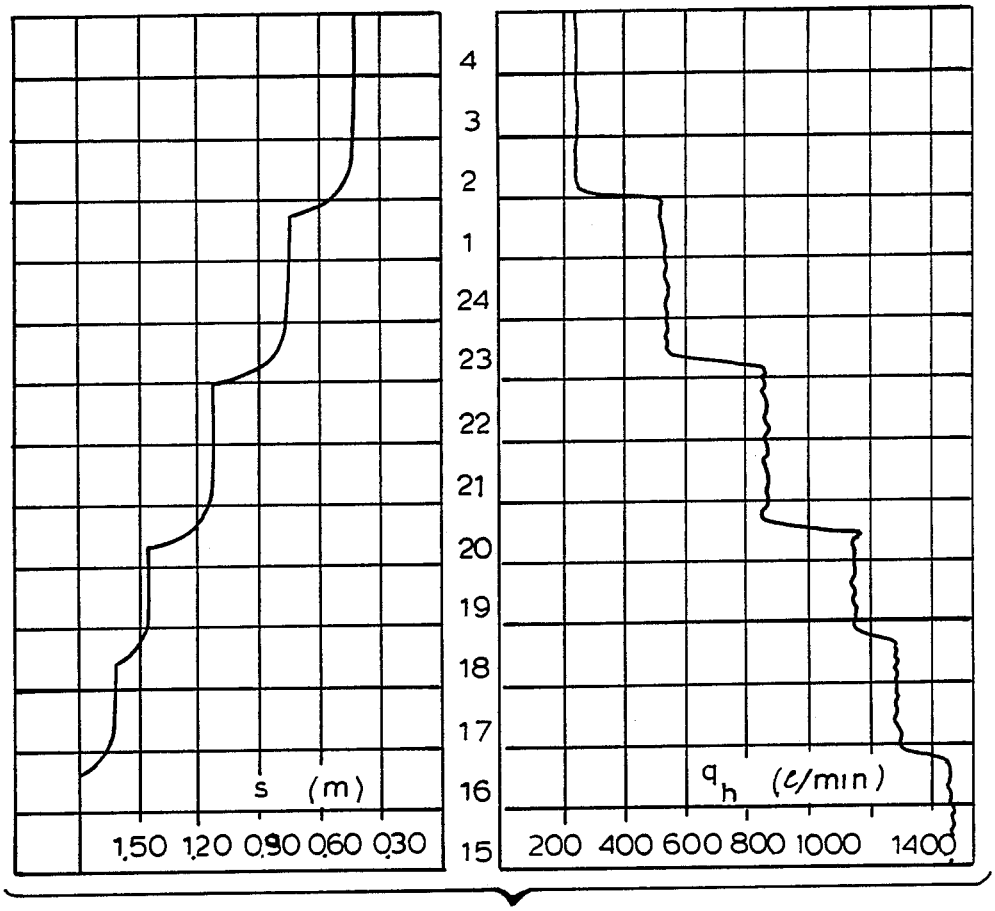
FIG. 1 presents the pumping from an observation tube, applying the stepwise pumping method.

As seen in FIG. 1, pumping from the observation tube is conducted in a stepwise manner, in such as way that successively spaced flows are induced in the soil by pumping the water and regularly changing the yield of the pump.

Measuring means are inserted in the observation tube for examining the water table during such pumping. Such means may include conventional, commercially available pressure transducers, capaciter or ultrasonic devices by which the water table or level is determined. Water is pumped from the observation tube at various yield rates, utilizing the so-called stepwise pumping method. Differing from the usual stepwise pumping, shorter than normal pumping periods are used, about 15 seconds to 20 minutes, depending on site and conditions. Of course, periods over 20 minutes in length may also be applied, but the time interval states have proved expedient.

Simultaneously, both the hydrostatic height of water in the observation tube at different yields and the water quantity that is pumped up. In the prior art, the pressure height was not measured. As taught by the invention, such measurement is made while carrying out pumping runs for determining the well's yield capacity.

Conventional magnetic or ultrasonic meters may be used to measure water flow and flow rates and quanlity.

An example of the step pumping measurements, recorded on a recorder output strip is shown in FIG. 1. The stylus on the right has recorded the yield Q from the observation tube and the stylus on the left, the level drops at the respective yield rates.

It is possible from the quantities that have been measured—from hydrostatic height and water quantity pumped up—to infer the hydraulic characteristics of the environment of the observation tube, and hereby it becomes possible with the aid of a correlation factor, as a function of level drop, to determine with substantial accuracy the true yield obtainable from a well, to be later situated in that location. That is, the results can be determined not by drilling the final well, but also by placing a smaller observation tube and by determining the parameter according to the present invention.

The basic pumping is conducted so that the output of the pump is regulated e.g. with a valve, to be 15 l/min. When the water table, i.e. the pressure, has stabilized (e.g. after 30 seconds), the pump is throttled to draw 12.5 l/min. The pressure is allowed to settle and a measurement is taken. The operation is carried on in this manner until an adequate number of results have been obtained.

On the basis of the values found in the stepwise pumping run, the water yield Q is plotted over the level drops. This yields a line which is straight i.e. linear up to a certain limit.

$$\frac{Q}{s} = k\frac{Q_h}{s}$$

$$\frac{Q_n}{S} = \text{the average value of the stepwise pumping of } n \text{ step} =$$

$$\frac{Q_1 - Q_2}{S_1 - S_2} \cdots + \cdots \frac{Q_n - Q_{n+1}}{S_n - S_{n=1}}$$

Q = water quantity obtainable from the ultimate operative well (in liters)

$Q_n$ = water quantity obtained from the observation tube (in liters) at a given measuring height h, s = level drop (in meters)

k = correlation factor

The correlation factor is determined by the following:

If the strainer tube has a length of, for instance, one meter and the depth of the ground water region is several meters, one has to perform the stepwise pumping so that the strainer section of the observation tube is, for instance, at first positioned at the highest point, where test pumpings are carried out. The strainer tube is then pushed one meter further down, and test pumpings are carried out. The procedure continues in this manner, until results have been obtained for the entire depth of the ground water region. The results thus obtained are combined, and the yield capacity of the intended well will then be the sum of the yields of the sections.

By means of this invention it is possible to find out the hydraulic characteristics of the soil (such as conductivity of the soil) making it possible to optimize the location and the length of the strainer of the water production well to be built, i.e., the production well can be built in the place having the best water conductivity characteristics, and there is no need for guessing or the use of an unnecessary long strainer to make sure that it will work. The strainer is very expensive.

If the observation tube diameter is 50 mm and the diameter of the well tube is 400 mm, the ratio of strainer surfaces equal in length will be the ratio of the diameters. Thus, the strainer surface of the well tube will be 8 times the surface of the observation tube's strainer, and accordingly the strainer resistance of the well will be lower by a factor of $\frac{1}{8}$.

Equation (2) can be solved for the ratio of the yield drops of well and observation tube (Q/s (k) and Q/x (hp), respectively) when the diameters are known $$\frac{Q/s\,(k)}{Q/s\,(hp)} = \frac{\log \frac{2{,}25\ Tt}{r_k{}^2 s}}{\log \frac{2{,}25\ Tt}{r_{hp}^2 s}}$$

If the well has r=0.2 m and the observation tube, r=0.025 m, then $$\frac{Q/s(k)}{Q/s(hp)} = 1{,}42$$

The above formula does not account for the strainer resistance.

Figure 2:
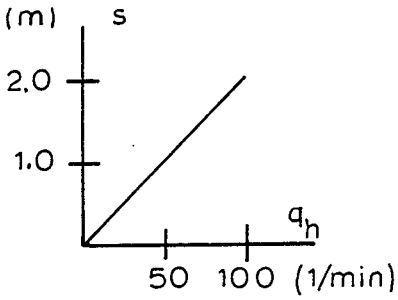
FIGS. 2, 3 and 4 show the graphs constructed from values found at three different heights, representing the water yield as a function of level drop.
Figure 3:
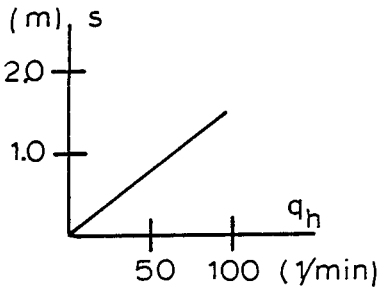
Figure 4:
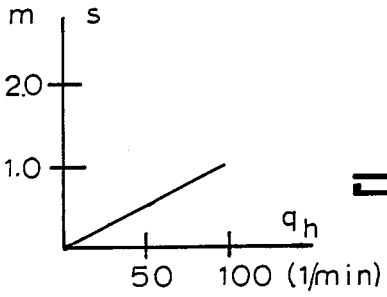

In order to elucidate the matter, there is presented, in the diagrams of FIGS. 2, 3 and 4, as an example the exploration of a ground water statum 3 m in height, as taught by the present invention.

The yield capacity of the deposit has been defined as presented in the foregoing. The task is: to find a well location and the yield capacity of the well with highest possible accuracy.

For this work, testing tubes are installed at favorable locations selected on the basis of earlier investigations. It is equally possible to use observation tubes installed earlier in the particular area.

The pumping runs are carried out in the manner of stepwise pumping, in order to determine the specific yield of the tube.

The deposit may be tested by individual strata with a strainer tube for instance 1 m in length, as has been done in the examples of FIGS. 2, 3 and 4.

The testing may also be done with a long strainer having a length equal to the total of the water-conducting strata, whereby an overall picture is obtained of the properties of the deposit. In that case the characteristics of the individual strata will not be revealed.

The deposit of the example presented a ground water deposit 3 m in height and location at depth 7–10 m.

Pumping at a depth of from 7 to 8 m by stepwise pumping, produces a yield Qh (in l/min) in a straight line, as a function of the level drop s as seen in FIG. 2. Thus, in FIG. 3 the tube depth is 8 to 9 m, and in FIG. 4 it is 9 to 10 m.

Figure 5:
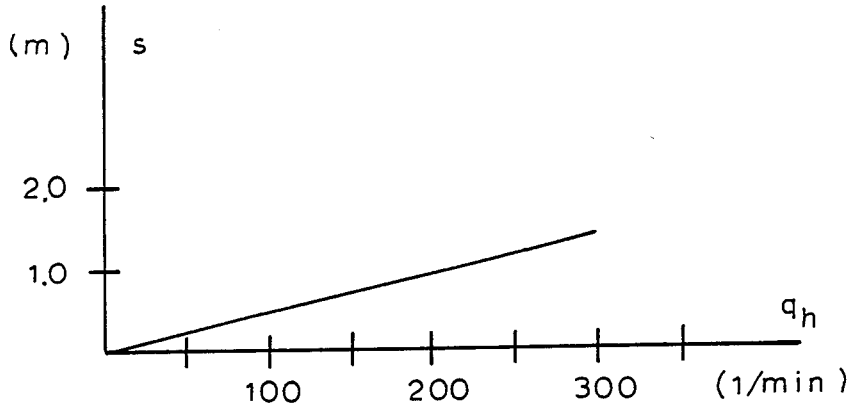
FIG. 5 represents the water yield over the entire ground water height, on the basis of the data given in FIGS. 2, 3 and 4.

From the above partial results, one finds by summation, the yuield as a function of level drop for the whole ground water region. At one meter level drop, the yields are 50, 67 and 100, totalling 217 l/min. This is illustrated by FIG. 5.

If the diameter of the strainer in the well is 400 mm, the ratio between the well's strainer and the strainer of the observation tube will be 400/50=8.

$$Q(\text{well}) = 217 \times 8 = \text{abt. } 1700(\text{liters per min. per m})$$

In case the strainers of the observation tube and of the well are different, the error hereby introduced has to be considered. It is taken into account by applying an empirical coefficient. In our example, the strainer are assumed to be similar, and therefore the yield of the well—1700 l/min when the level drop was 1 m.

According to the formula (2) above, $Q/s/Qh/S=k'$.

When the level drop s is the same in the observation tube and in the well, $Q=k'Qh$. In the case of our example, $Q/Qh=1.42$. The formula accounts for the flow resistance in the soil. Experience has taught that the correct k and k', i.e., in the example it is between 1.42 and 8, depending on the flow resistance. It has been found that by using the procedure of the invention values, more consistent with reality are obtained than with the methods used heretofore, even though the value of k remains to be empirically corrected, as in the example.

At present, those ground waters which are close to the surface are already largely being utilized. Therefore endeavours are and will be made to concentrate water supply activities on the central parts of eskers, where the ground water table is at greater depth than 8 m.

The so-called deep exploration technique is exceedingly cumbersome, and often outright unfeasible, as an aid in dimensioning wells producing water from the central strata.

The procedure of the invention may be applied for utilizing ground water deposits occurring at great depth, by "inversion". Herein, through an observation tube, in which the above-mentioned measuring instruments have been introduced, water is pumped into the ground. Thereafter, by applying the stepwise pumping method described above and by using the time intervals mentioned, different water quantities are obtained. In this case, too, the hydrostatic height of the water in the observation tube and the water quantities per unit time are measured.

Figure 6:
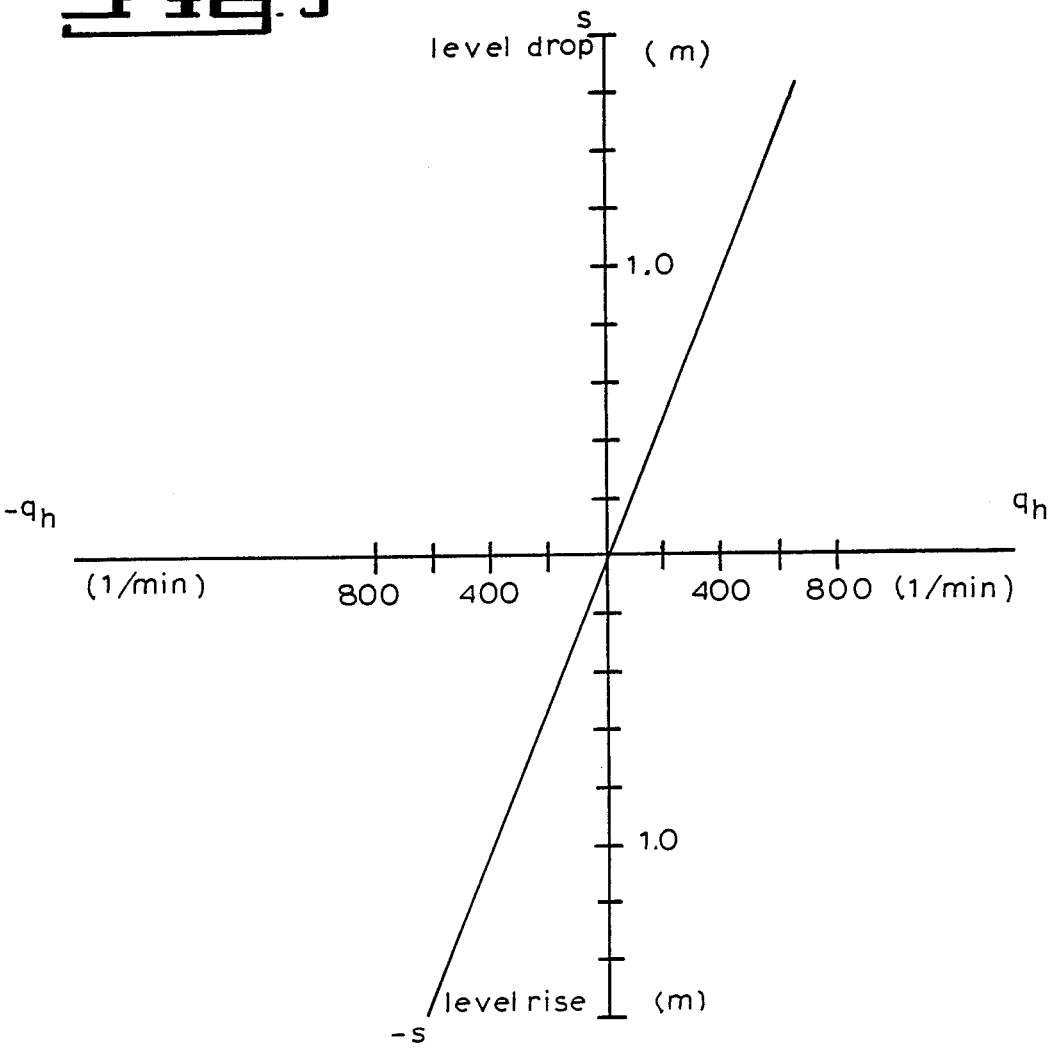
FIG. 6 illustrates the pumping in the direction towards the ground water, employed in exploring a ground water region located at great depth.

In FIG. 6, water has been pumped into the well, applying the step-wise pumping principle of the invention. This has yielded the diagram on the left side in FIG. 6, where—Qh means water being absorbed in the soil and—s is the level rise, as opposed to level drop. By extending the straight line in the figure past the origin, a straight line is obtained which here corresponds to the yield of the observation tube, which is the same as would be the case if water could have been pumped out from the observation tube.

The principle is the same in both procedures of exploration. Only the direction of flow of water is reversed.

It is essential in the invention that in dimensioning the well, stepwise pumping is applied in the observation tube, the time intervals being short (between 15 seconds and 20 minutes). In this manner of pumping, the hydrostatic height of the water column is measured. In this way is obtained the value Qh/s for the observation tube. The corresponding Q/s for the well is found with the aid of the correlation factor k.

By working according to this procedure, better results for dimensioning ground water wells are achieved than with any method of prior art.

What is claimed is:

1. A method for pre-determining the dimensions of a ground water production well comprising the steps of sinking an observation tube having a strainer in the ground, carrying out a series of pumping runs in said tube, said pumping being carried out stepwise and having flows with different velocities induced in the soil, measuring the flow quantity and hydrostatic height in the tube caused in each of the pumping runs, and extrapolating from said measurement, the yield of an ultimate production well to be built at the place of the observation tube.

2. The method according to claim 1, wherein the stepwise pumping is carried out using short pumping periods, and the hydrostatic water height is measured at different yields, respectively, and the yield of the observation tube is found as a function of the level drop, from which the ultimate yield capacity of the well to be built is found by multiplying the yield of the observation tube by a predetermined correlation factor.

3. The method according to claim 2, wherein said pumping periods range between 15 seconds and 20 minutes.

4. Procedure according to claim 2, wherein, when the strainer of said observation tube is shorter than the height of ground water in the area, pumping runs are carried out over the entirerange of ground water hydrostatic height, and the strainer is moved through a distance equalling the length of said tube, so that a plurality of pumping results are obtained over the entire height of the ground water, the total yield being plotted as the sum of the partial yields with the same level drop.

5. Procedure according to claim 4, comprising the steps of performing the pumping runs into the tube in the direction towards the ground water, and measuring the specific yield capacity at each step and plotting said specific yields before extrapolation.

6. Procedure according to claim 2, comprising the steps of performing the pumping runs into the tube and the direction towards the ground water, and measuring the specific yield capacity at each step and plotting said specific yields before extrapolation.

7. The method according to claim 1, wherein when the strainer part of the said observation tube is shorter than the hydrostatic height of the ground water in the area, separate pumping runs are carried out over the entire range of ground water hydrostatic height, and the strainer of the said observation tube is moved through a distance equalling the length of said tube so that pumping results are obtained over the entire range of hydrostatic height of the ground water, the total yield being plotted as the sum of the partial yields with the same level drop.

8. Procedure according to claim 7, comprising the steps of performing the pumping runs into the tube in the direction towards the ground water, and measuring the specific yield capacity at each step and plotting said specific yields before extrapolation.

9. The method according to claim 1, comprising the steps of performing the pumping runs into the tube in the direction towards the ground water, and measuring the specific yield capacity at each step and plotting said specific yields before extrapolation.

* * * * *